United States Patent [19]

Todd et al.

[11] Patent Number: 4,604,878

[45] Date of Patent: Aug. 12, 1986

[54] LATCH ACTUATOR CAM OF DOOR LOCKS

[75] Inventors: Terry J. M. Todd, Willowdale; Josip Vulakovic, Weston, both of Canada

[73] Assignee: Papaiz of Canada Limited, St. Catharines, Canada

[21] Appl. No.: 695,569

[22] Filed: Jan. 28, 1985

[51] Int. Cl.[4] ..... E05B 65/06

[52] U.S. Cl. ..... 70/139; 292/200

[58] Field of Search ..... 70/107, 136, 137, 138, 70/139; 292/96, 97, 100, 122, 126, 150, 196, 199, 200, 220, 226

[56] References Cited

U.S. PATENT DOCUMENTS

| | | | |
|---|---|---|---|
| 2,854,839 | 10/1958 | Eads | 70/139 |
| 3,899,906 | 8/1975 | Bradstock | 70/139 |
| 4,127,016 | 11/1978 | Ibse | 292/200 |
| 4,218,903 | 8/1980 | Eads | 292/200 |

*Primary Examiner*—Robert L. Wolfe

*Attorney, Agent, or Firm*—Fetherstonhaugh & Co.

[57] ABSTRACT

An improvement in a door lock of the type having a rotatably mounted cam which has a detent which serves to displace a latching member and to engage the downstream abutment member of a pair of abutment members which are arranged upstream and downstream of the locking member with respect to the direction of rotation of the actuator cam. The abutment members are mounted on a lever arm which is connected to a locking bolt such that rotation of the actuator cam in one direction or the other will cause the detent to displace the locking member and thereafter engage the downstream abutment member to effect movement of the lever arm which in turn effects movement of the locking bolt between an open position and a closed position and to move the downstream abutment member clear of the path of the detent so as to permit the detent to gain access to the locking member when the direction of rotation of the actuator cam is reversed. The improvement is in the provision of first and second abutments formed on the actuator cam and arranged one on either side of the detent so as to engage the upstream abutment member to arrest the movement of the actuator cam after displacement of the downstream abutment member to the position in which it is clear of the path of travel of the detent such that the rotation of the actuator member is restricted to about 90°.

3 Claims, 6 Drawing Figures

LATCH ACTUATOR CAM OF DOOR LOCKS

FIELD OF INVENTION

This invention relates to improvements in door locks. In particular, this invention relates to improvements in door locks of the type manufactured and sold by Adams Rite Industries as described in Canadian Patent No. 1,016,975 dated Sept. 6, 1977, Bradstock.

PRIOR ART

The actuator member of the lock described in the Bradstock patent includes a conventional key-operated rotor shaft which must be rotated through 360° to permit removal of the key. The actuator cam has a profile which includes a detent or cam extension which engages the latching member which is slidably mounted in the lever arm to move the latching member out of one or other of the dwell notches which are located at opposite ends of the actuator slot in which the latching member moves in relation to the lock casing. The cam extension then engages the downstream abutment member which is carried by the lever arm thereby to move the lever arm to effect movement of the locking bolt between its open and closed positions.

The door locks of this type are commonly used in large commercial buildings and fire regulations and many jurisdictions provide that the doors to such buildings must be capable of being opened by operation of a handle which does not require dexterity on the part of the user to effect opening and closing of the lock. In case of fire, the occupants attempting to escape a building may have their ability to locate a key in a lock impaired by the effect of the fumes generated by the fire or inability to see the lock opening because of the smoke generated by the fire.

Because of the fact that it is necessary to rotate the actuator shaft through 360°, it is not possible to mount a conventional handle on the actuator shaft as the handle would foul with the door jamb and would not be capable of being rotated through 360°.

To overcome this difficulty, in some jurisdictions, the fire departments have permitted the use of a short T-shaped handle commonly known as a thumb handle. By making the handle very short, it is possible to obtain the required 360° rotation without fouling with the door jamb. This type of handle is not, however, considered to be the most desirable form of handle by those responsible for fire safety regulations, the preferred form of handle being the conventional lever arm handle which is normally moved through 90° to effect opening and closing of a door lock.

The actuator cam and the abutment members of the Bradstock patent are specifically designed and arranged to ensure that the downstream abutment is displaced out of the path of travel of the detent or cam extension when the rotation of the actuator is completed in a first direction such that when the direction of rotation of the cam is reversed, the abutment member which had previously been the downstream abutment member and is now the upstream abutment member is located out of the path of the primary node so that the detent or cam extension can gain access to the locking member to effect displacement of the locking member. To permit 360° rotation of the actuator shaft, the downstream abutment member must be displaced out of the path of travel of the detent.

Various attempts have been made to modify the Bradstock structure to permit operation by means of a conventional handle. These attempts have, however, required radical modification of the abutment members of the lever arm and the locks which have been modified have experienced difficulties in use resulting from these modifications and as a result have not been widely accepted.

SUMMARY OF INVENTION

We have found that we can obtain the required 90° handle operation of the lock by providing a simple and inexpensive replacement actuator cam. The actuator cam has first and second abutments arranged one on either side of the actuator detent so as to engage the upstream abutment members of the lever arm to arrest the movement of the actuator cam after displacement of the downstream abutment member of the lever arm to limit the rotation of the actuator member to a predetermined angular displacement.

According to one aspect of the present invention, there is provided in a door lock of the type having a rotatably mounted cam which has a detent which serves to displace a latching member and to engage the downstream abutment member of a pair of abutment members which are arranged upstream and downstream of the locking member with respect to the direction of rotation of the actuator cam, the abutment members being mounted on a lever arm which is connected to a locking bolt such that rotation of the actuator cam in one direction or the other will cause the detent to displace the locking member and thereafter engage the downstream abutment member to effect movement of the lever arm which in turn effects movement of the locking bolt between an open position and a closed position and to move the downstream abutment member clear of the path of the detent so as to permit the detent to gain access to the locking member when the direction of rotation of the actuator cam is reversed, the improvement of first and second abutments formed on the actuator cam and arranged one on either side of the detent so as to engage the upstream abutment member to arrest the movement of the actuator cam after displacement of the downstream abutment member to the position in which it is clear of the path of travel of the detent such that the rotation of the actuator member is restricted to about 90°.

According to yet another aspect of the present invention there is provided an actuator assembly for use in a door lock of the type having a detent for displacing a latching pin which is mounted on a lever arm which is connected to a locking bolt, the lever arm having abutment members located one on either side of the path of travel of the latching pin and the shaft mounted for rotation proximate the latching pin, said actuator assembly comprising an actuator housing, an actuator shaft mounted for rotation in said housing, said actuator shaft having first and second ends at opposite ends of said actuator housing, a longitudinally elongated actuator handle having one end mounted on said first end of said actuator shaft, the longitudinal extent of said handle projecting radially from one side of said actuator shaft, an actuator cam mounted on said second end of said actuator shaft, said actuator cam having; an axis of rotation, a detent projecting radially from said axis of rotation and first and second abutment means formed on the actuator cam and arranged one on either side of the detent so as to engage the upstream abutment member to arrest the movement of the actuator cam after displacement of the downstream abutment member to a position in which it is clear of the path of travel of the detent such that the rotation of the actuator member is restricted to about 90°.

PREFERRED EMBODIMENTS

The invention will be more clearly understood after reference to the following detailed specification read in conjunction with the drawings wherein.

Figure 1:
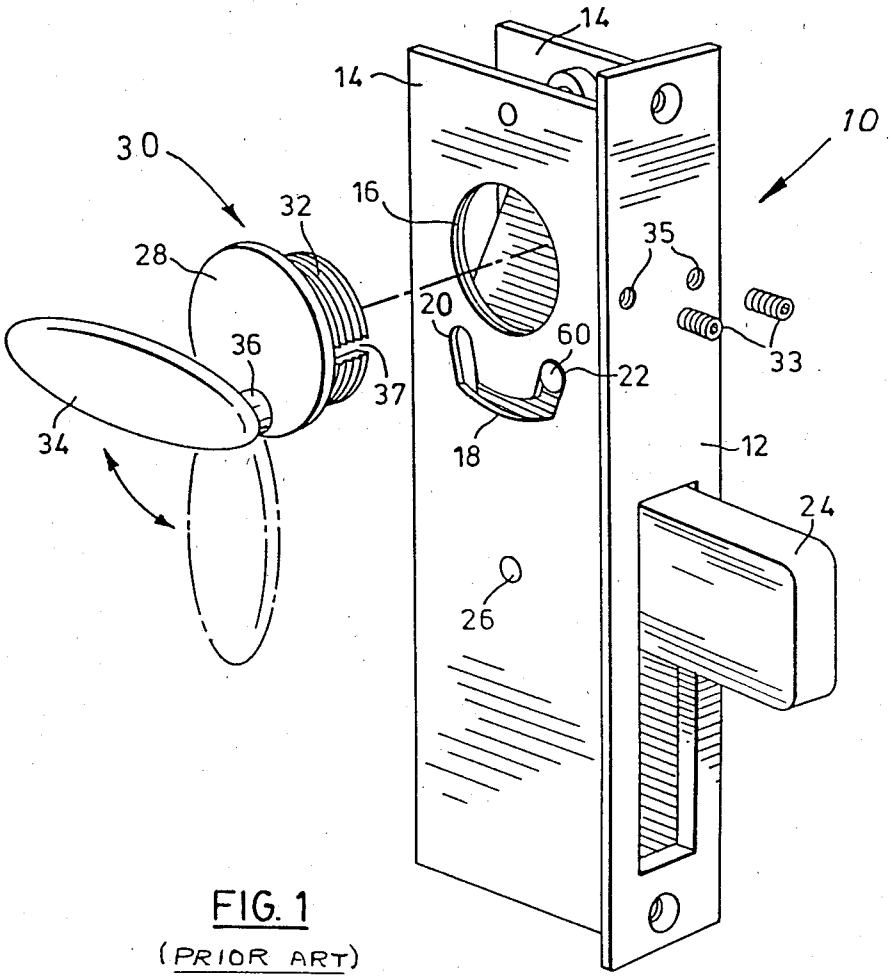
FIG. 1 (PRIOR ART)
FIG. 1 is a partially exploded side view of a door lock constructed in accordance with an embodiment of the present invention.

With reference to FIG. 1 of the drawings, the reference numeral 10 refers generally to a door lock assembly suitable for use in a narrow stile such as an extruded metal door frame. Assemblies of this type are well known and as previously indicated, one such assembly is described in Canadian Patent No. 1,016,975. The assembly includes a casing 12 which has side walls 14 in each of which a threaded passage 16 is formed. A slot 18 is formed in each side wall 14 and has dwell notches 20 and 22 extending upwardly at opposite ends thereof. A locking bolt 24 is pivotally mounted on a pivot pin 26 which is retained by the side walls 14. A lock housing 28 has a threaded body portion 32 adapted to be threadedly mounted in either of the passages 16. Grub screws 33 are threadedly mounted in passages 35 and serve to extend into slots 37 formed in the threaded body portion 32 to return the lock housings 28 against rotation.

The present invention provides a simple and inexpensive modification to the actuator cam of a door lock and an actuator assembly which includes the modified cam and an elongated operating handle of the type suitable for use in a narrow door stile.

The actuator assembly is generally identified by the reference numeral 30 consists of the lock housing 28, an actuator shaft 36 and an actuator handle 34. The actuator shaft has first and second ends at opposite ends of the lock housing 28. A longitudinally elongated actuator handle 34 has one end mounted on the first end of the actuator shaft 36. The longitudinal extent of the handle 34 projects radially from one side of said actuator shaft. The actuator cam 74 is mounted on said second end of said actuator shaft. The actuator cam is mounted for rotation about the axis of rotation 78. As will be discribed herein after a detent 82 projects radially from the axis of rotation and first and second abutments 84, 86 are formed on the actuator cam and arranged one on either side of the detent so as to engage the upstream abutment member to arrest the movement of the actuator cam after displacement of the downstream abutment member to a position in which it is clear of the path of travel of the detent such that the rotation of the actuator member is restricted to about 90°.

The operating handle 34 is mounted on a shaft 36 for angular movement between the horizontal position shown in solid lines and the vertical position shown in broken lines.

Figure 2:
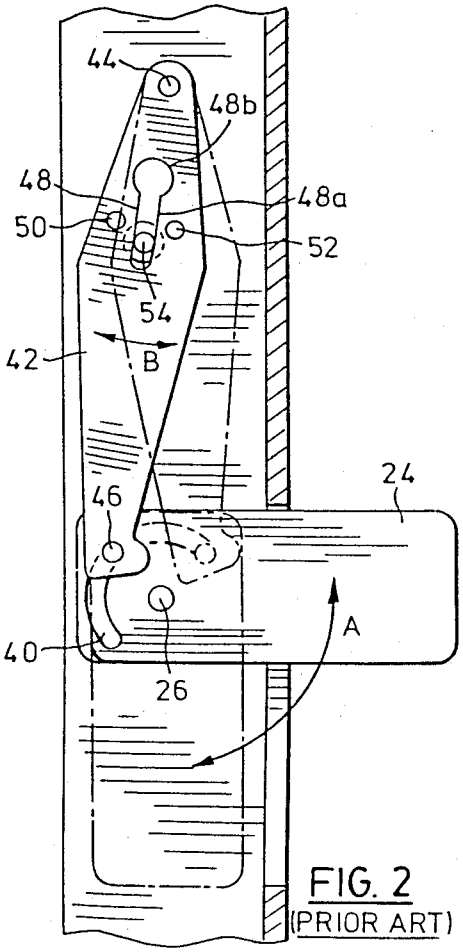
FIG. 2 (PRIOR ART)
FIG. 2 is a sectional side view of the door lock of FIG. 1.
Figure 6:
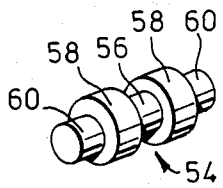
FIG. 6 is a pictorial view of a latching pin which is used in the door lock of FIG. 1.
Figure 5:
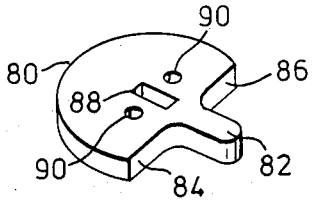
FIG. 5 is a pictorial view of the actuator cam of the present invention.

As shown in FIG. 2 of the drawings, the locking bolt 24 has an arcuate shaped slot 40 located at its inner end. A lever arm 42 has one end pivotally mounted on a pivot pin 44 so as to be movable to and fro in the direction of the arrows B. A pin 46 is secured to the other end of the lever arm 42 and extends into the arcuate slot 40. The lever arm 42 has a key-hole shaped slot 48 formed therein. A pair of abutment posts 50 and 52 are arranged one on either side of the slot 48 and project from each side face of the lever arm 42 toward the adjacent side wall 14 of the housing. A latching pin 54 (see also FIG. 6) has a central portion 56 of reduced diameter slidably mounted in the narrow elongated portion **48*a* of the slot 48 with the enlarged spacer portions 58 located on opposite sides of the lever arm 42 such that the latching portions 60 project into the slots 18 as shown in FIG. 1. The enlarged portion 48*b* of the key-hole slot 48 as proportioned to permit the enlarged portions 58 of the latching pin to extend therethrough to permit the latching pin 54** to be mounted in a manner illustrated in FIG. 2.

Figure 3:
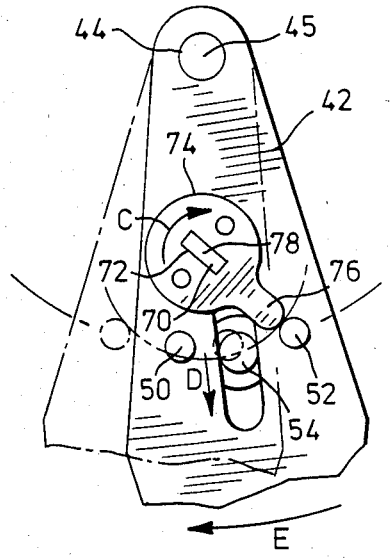
FIG 3 (PRIOR ART)
FIG. 3 is an enlarged detailed view of the cam actuator of the prior art.

The inner end of the shaft 36 has a rectangular shaped lug 70 (FIG. 3) which projects into a corresponding rectangular shaped slot 72 in the actuator cam 74. The cam 74 has a detent 76 which projects radially outwardly from the axis of rotation 78. In order to unseat the latching pin 54 from the dwell notch 22, the cam 74 is rotated in the direction of the arrow C. The upstream abutment post 52 is out of the path of travel of the detent 76 with the result that the detent 76 can move to a point where it engages the latching pin 54 and continued rotation will displace the latching pin 54 in the direction of the arrow D, thus unseating the latching pin 54 from the dwell notch 22. Continued rotation of the cam 74 in the direction of the arrow C will bring the detent 76 into engagement with the abutment post 50 at which time the lever arm 42 will begin to pivot in the direction of the arrow E about its axis of rotation 45. Displacement of the lever arm 42 in the direction of the arrow E will cause the locking bolt 24 to move from the broken line stored position shown in FIG. 2 to the solid line locking position by reason of the interaction of the pivot pin 46 and slot 40. When the lever arm 42 is in the position shown in FIG. 2, the abutment 50 is displaced out of the path of travel of the detent 76 with the result that the cam 74 may continue its rotation in the direction of the arrow C until a 360° rotation has been completed to permit removal of the operating key.

The mechanism described hereinabove is a known mechanism which includes appropriate biasing springs for spring loading the latching pin 54.

Figure 4:
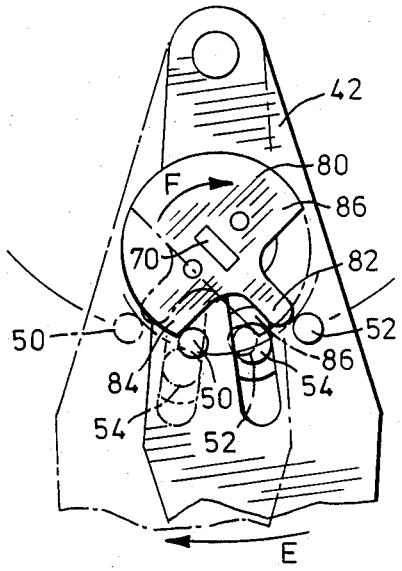
FIG. 4 is an enlarged detailed view similar to FIG. 3 showing the operation of the actuator cam of the present invention.

The improvement of the present invention resides in the configuration of the cam plate 80. The cam plate 80 is formed with a detent 82 which performs the same function as the detent 76 of the known cam plate 74. The cam plate 80 is, however, formed with abutment shoulders 84 and 86. The cam 80 has a mounting slot 88 and mounting passages 90. The slot 88 receives the rectangular shaped lug 70 of the shaft and mounting screws (not shown) extend through the passages 90 and are threaded into the end of the shaft 36 to securely retain the cam plate 80. As shown in FIG. 4 of the drawings, rotation of the cam plate 80 in the direction of the arrow F will cause the detent 82 to displace the latching pin 54 as previously described and engagement of the detent 82 with the abutment pin 50 will cause the lever arm 42 to pivot in the direction of the arrow E. However, once the lever arm 42 has reached its second operating position, the abutment shoulder 86 will come to rest on the abutment pin 52, thus limiting the angular displacement of the cam 80 to no more than 90°. As previously indicated, the handle 34 is mounted on the outer end of the shaft 36 on which the lug 70 is formed with the result that the 90° movement of the cam 80 can be achieved by displacing the handle 34 through 90°. By reversing the direction of rotation of the handle 34, the cam 80 will be returned from the position shown in broken lines to the position shown in solid lines in FIG. 4, as a result of which the latching pin 54 will be again displaced by engagement with the detent 82 and rotation of the cam 80 will continue until the abutment shoulder 84 bears against the abutment pin 50.

Thus, it will be seen that the improvement of the present invention resides in the provision of the abutment shoulders 84 and 86 which are arranged so as to bear against the abutment pins 50 and 52 when at opposite ends of the angular displacement thereof. Thus, the interaction of the abutment shoulders 84, 86 and abutment pins 50, 52, serves to limit the angular displacement of the handle 34 and provide a positive stop at each limit. The handle operated cam actuator of the present invention may be located on the inside face of the door while a key operated lock may be located on the outside of the door. The key operated lock having a cam plate 74 of the type previously described with the result that while it is possible to operate the locking bolt from the inside of the door by rotating the handle 34 as previously described, it is necessary to utilize a key to obtain access from the outside of the door. Alternatively, where a security key lock is not required, a handle operated mechanism may be located on both sides of the housing.

The embodiments of the invention in which an exclusive property or privilege is claimed are defined as follows:

1. In a door lock of the type having a rotatably mounted cam which has a detent which serves to displace a latching member and to engage a downstream abutment member of a pair of abutment members which are arranged upstream and downstream of a locking member with respect to the direction of rotation of an actuator cam, the abutment members being mounted on a lever arm which is connected to a locking bolt such that rotation of the actuator cam in one direction or the other will cause the detent to displace the locking member and thereafter engage the downstream abutment member to effect movement of the lever arm which in turn effects movement of the locking bolt between an open position and a closed position and to move the downstream abutment member clear of the path of the detent so as to permit the detent to gain access to the locking member when the direction of rotation of the actuator cam is reversed, the improvement of;

first and second abutments formed on the actuator cam and arranged one on either side of the detent so as to engage the upstream abutment member to arrest the movement of the actuator cam after displacement of the downstream abutment member to the position in which it is clear of the path of travel of the detent such that the rotation of the actuator member is restricted to about 90°.

2. An actuator cam for use in a door lock of the type having a detent for displacing a latching pin which is mounted on a lever arm which is connected to a locking bolt, the lever arm having abutment members located one on either side of a path of travel along which the latching pin is movable, and a shaft mounted for rotation proximate the latching pin for supporting said actuator cam for angular movement about said axis, said abutment members being positioned in an upstream position and a downstream position with respect to one another relative to the direction of rotation of said actuator cam in use, said actuator cam comprising a cam body having an axis of rotation, a detent projecting radially from said axis of rotation and first and second abutment means formed on the actuator cam and arranged one on either side of the detent so as to engage the abutment member which is located in the upstream position to arrest the movement of the actuator cam after displacement of the abutment member which is located in said downstream position to a position in which it is clear of the path of travel of the detent such that the rotation of the actuator member is restricted to about 90°.

3. An actuator assembly for use in a door lock of the type having a detent for displacing a latching pin along a path of travel, said latching pin being mounted on a lever arm which is connected to a locking bolt, the lever arm having abutment members located one on either side of the path of travel of the latching pin and a shaft mounted for rotation proximate the latching pin, said actuator assembly comprising an actuator housing, an actuator shaft mounted for rotation in said housing, said actuator shaft having first and second ends at opposite ends of said actuator housing, a longitudinally elongated actuator handle having one end mounted on said first end of said actuator shaft, the longitudinal extent of said handle projecting radially from one side of said actuator shaft, an actuator cam mounted on said second end of said actuator shaft, said actuator cam having; an axis of rotation, a detent projecting radially from said axis of rotation and first and second abutment means formed on the actuator cam and arranged one on either side of the detent so as to engage the upstream abutment member to arrest the movement of the actuator cam after displacement of the downstream abutment member to a position in which it is clear of the path of travel of the detent such that the rotation of the actuator member is restricted to about 90°.

* * * * *